US007314648B1

(12) United States Patent
Stewart et al.

(10) Patent No.: US 7,314,648 B1
(45) Date of Patent: Jan. 1, 2008

(54) TOUGHENED UNI-PIECE, FIBROUS, REINFORCED, OXIDIZATION-RESISTANT COMPOSITE

(75) Inventors: David A. Stewart, Santa Cruz, CA (US); Daniel B. Leiser, San Jose, CA (US)

(73) Assignee: United States of America as represented by the Administrator of the National Aeronautics and Space Administration (NASA), Washington, DC (US)

( * ) Notice: Subject to any disclaimer, the term of this patent is extended or adjusted under 35 U.S.C. 154(b) by 171 days.

(21) Appl. No.: 10/911,747

(22) Filed: Jul. 27, 2004

Related U.S. Application Data

(63) Continuation-in-part of application No. 10/779,504, filed on Feb. 12, 2004.

(51) Int. Cl.
*B05D 7/00* (2006.01)

(52) U.S. Cl. ..... 427/299; 428/137; 428/138

(58) Field of Classification Search ..... 427/299; 428/137, 138
See application file for complete search history.

(56) References Cited

U.S. PATENT DOCUMENTS 4,083,771 A 4/1978 O'Hara
4,093,771 A * 6/1978 Fletcher et al. ..... 428/312.6
4,148,962 A 4/1979 Leiser et al.
4,713,275 A 12/1987 Riccitiello et al.
5,079,082 A * 1/1992 Leiser et al. ..... 428/307.7
5,985,433 A * 11/1999 Leiser et al. ..... 428/312.6
6,225,248 B1 5/2001 Leiser et al.
6,497,390 B1 * 12/2002 Fischer et al. ..... 244/171.7

OTHER PUBLICATIONS

Curry, et al., Material Characteristics of Space Shuttle Rein . . . , Proc of the 24th National Symposium and Exhibition,Book 2, May 8-10, 1979, 1524-1539, San Francisco, CA, USA.
Riccitello, et al., A Ceramic Matrix Composite Thermal Protection System for Hypersonic Vehicles, SAMPE Quarterly, May 1, 1993, 10-17,24-4, USA.
Stewart, et al., Thermal Response of Integrated Multicomponent Com . . . , Ceramic Engineering and Science Proc, Jul. 1987, 613-625, vol. 8-No. 7-8, American Ceramic Society, Inc.
First Office Action, dated Oct. 20, 2006, from patent application U.S. Appl. No. 10/779,504, parent to the above identified application.

* cited by examiner

*Primary Examiner*—Kirsten Jolley
(74) *Attorney, Agent, or Firm*—John F. Schipper; Robert M. Padilla

(57) ABSTRACT

A composite thermal protection structure, for applications such as atmospheric re-entry vehicles, that can withstand temperatures as high as 3600° F. The structure includes an exposed surface cap having a specially formulated coating, an insulator base adjacent to the cap with another specially formulated coating, and one or more pins that extend from the cap through the insulator base to tie the cap and base together, through ceramic bonding and mechanical attachment. The cap and insulator base have corresponding depressions and projections that mate and allow for differences in thermal expansion of the cap and base. A thin coating of a reaction cured glass formulation is optionally provided on the structure to allow reduce oxidization and/or to reduce catalytic efficiency.

16 Claims, 9 Drawing Sheets

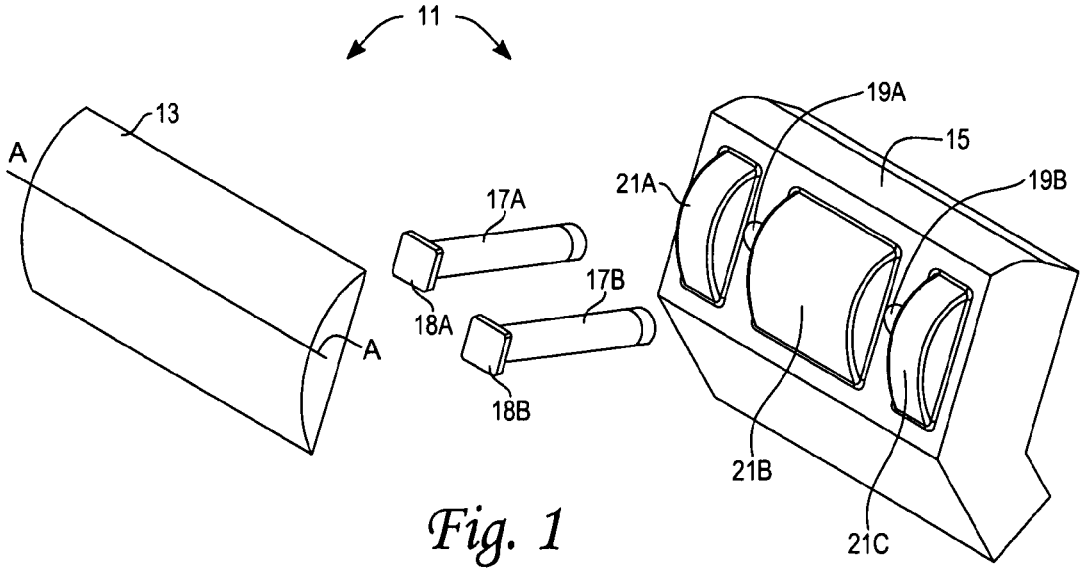
Fig. 1
Fig. 1A
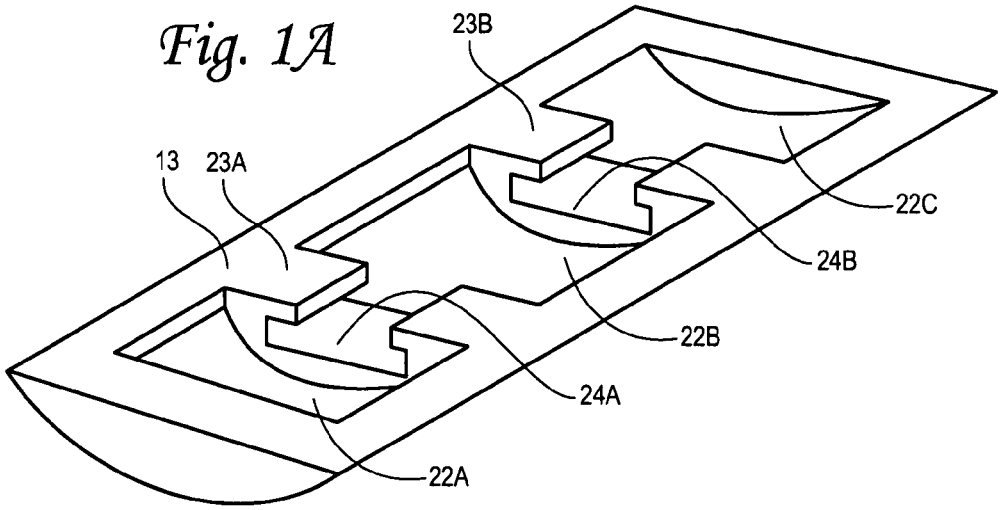
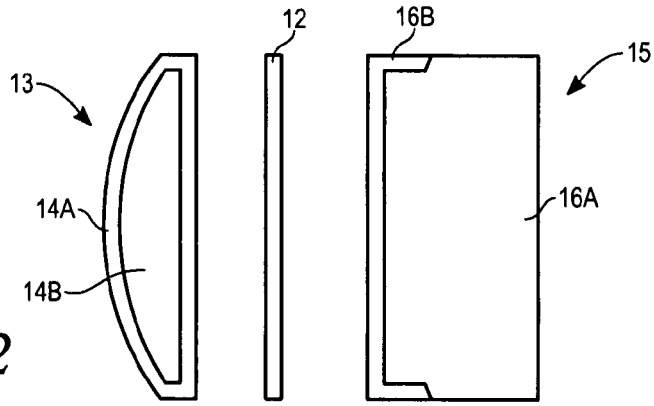
Fig. 2

TOUGHENED UNI-PIECE, FIBROUS, REINFORCED, OXIDIZATION-RESISTANT COMPOSITE

CROSS REFERENCE TO RELATED APPLICATIONS

This application is a continuation-in-part of prior application Ser. No. 10/779,504, filed Feb. 12, 2004.

ORIGIN OF THE INVENTION

The invention described herein was made by employees of the United States Government and may be manufactured and used by or for the Government for governmental purposes without the payment of any royalties thereon or therefor.

TECHNICAL FIELD

The present invention is a toughened uni-piece, thermal protection system suitable for use in a re-entry environment on a space vehicle.

BACKGROUND OF THE INVENTION

A vehicle intended to be used in space exploration, above the atmosphere, must survive an initial ascent into the exo-atmosphere and a subsequent re-entry into and through the atmosphere. During the initial ascent; the space vehicle is accelerating from relatively low speeds to higher speeds (e.g., no higher than several hundred kilometers per hour) but is subjected to large mechanical stresses, including those generated by high frequency vibrations. During the re-entry, the space vehicle is traveling at speeds of the order of 25,000 Km/hour over the time interval during which maximum heating occurs. In the re-entry phase, this can result in temperatures up to 3000° F. on the leading edges of the vehicle for a time interval as long as about 10 minutes. The heating environment also produces very high thermal gradients, where the local temperature decreases from about 3000° F. to below 400° F. over several centimeters; this poses another challenge, where adjacent materials do not have identical thermal expansion coefficients.

What is needed is an exposed surface design and appropriate materials combination for a space vehicle that will survive the mechanical stresses induced in the initial ascent and will subsequently survive the extreme heating and mechanically stressful environment of re-entry. Preferably, the material should be relatively lightweight (ideally 10-20 $lbs/ft^3$; up to 60 $lbs/ft^3$) and should be modular so that exposed surface portions of the vehicle that are damaged or compromised can be easily replaced. Preferably, the system should not require precise matching of thermal expansion coefficients for the materials used in the design.

SUMMARY OF THE INVENTION

These needs are met by the invention, which provides a thermal protection tile attachment system, suitable for application to a space vehicle leading edge and for other uses in extreme heating environments (up to 3600° F., and possibly higher, for short time intervals). In one embodiment, for a re-entry vehicle leading edge, the system has four primary components: an exposed surface cap; an insulator base attached to the cap; a bonding agent (transition region) between the cap and the insulator base; and one or more interlocking pins, each pin being connected through the insulator base to the cap by a mechanical attachment and by a ceramic bonding attachment. The cap includes a high temperature, low density, carbonaceous, fibrous material whose surface is optionally treated with a HETC formulation, the fibrous material being drawn from the group consisting of silicon carbide foam and similar porous, high temperature materials. The insulator base and pin(s) contain similar material, which may be toughened uni-piece fibrous insulation. The mechanical design is arranged so that thermal expansion differences in the component materials (e.g., cap and insulator base) are easily tolerated. Optionally, a thin coating of reaction cured glass (RCG) formulation is applied to one or more components of the structure to reduce oxidization and decrease catalytic efficiency.

BRIEF DESCRIPTION OF THE DRAWINGS

FIG. 1 is an exploded perspective view illustrating an embodiment of a system, illustrating several components of the invention.

FIG. 1A is an alternative view of components in FIG. 1.

FIG. 2 is a cross-sectional view of the system in FIG. 1.

DESCRIPTION OF BEST MODES OF THE INVENTION

Figure 3:
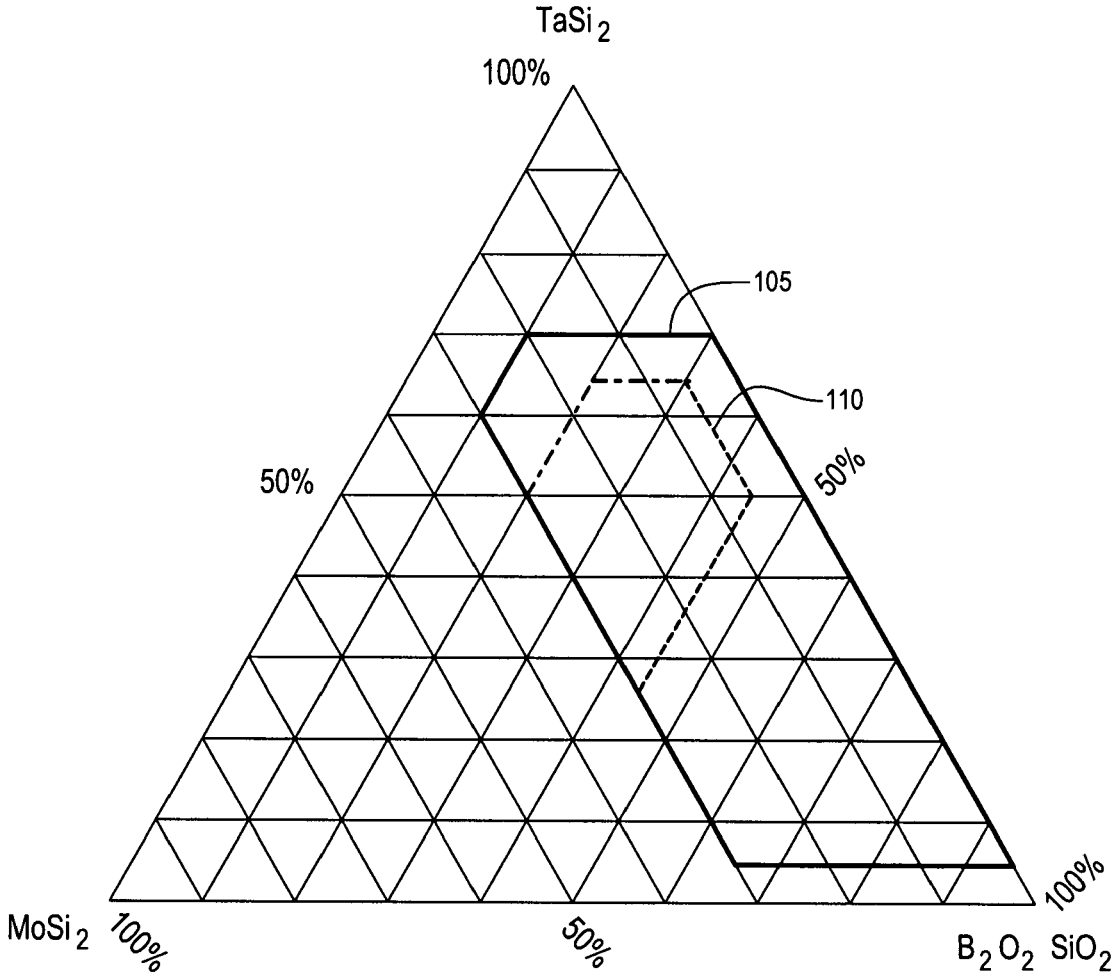
FIG. 3 is a composition diagram for a HETC surface treatment used in accordance with the invention.

FIG. 1 illustrates, in an exploded perspective view, an embodiment of a design for a space vehicle leading edge according to the invention. The modular design 11 includes an exposed surface cap 13 and an insulator base 15, spaced apart from each other, and one or more (preferably two or more) attachment pins, 17A and/or 17B. The pin, 17A and/or 17B, fits through a corresponding aperture, 19A and/or 19B, in the insulator base 15 and is mechanically attached to and ceramically bonded to the cap 13 at a first pin end and to the insulator base 15 at a second pin end. The pin, 17A and/or 17B, at the first end, optionally has a small plate or buttress thread, 18A and/or 18B, which is bonded within a boss, 23A and/or 23B, and associated keyway, 24A and/or 24B, that are machined as part of the cap 13, to provide better mechanical connection, as illustrated in FIG. 1A. Optionally, a polymer-glass mixture is used as a ceramic bonding agent. The polymer acts as an initial temporary bond, and the mixture becomes the final bond.

The insulator base 15 has two or more spaced apart projections, 21A, 21B and/or 21C, a polygonal or curvilinear shape and formed at an interface between the base and the cap 13. The cap has two or more spaced apart depressions, 22A, 22B and/or 22C, illustrated in FIG. 1A, that mate with the corresponding projections, 21A, 21B and/or 21C in the insulator base 15. Optionally, the width of each of two adjacent projections, for example, 21A and 21B, is slightly smaller than the width of the two corresponding depressions, for example, 22A and 22B, to allow for differential thermal expansion between the material(s) used for the cap 13 and the materials(s) used for the insulator base 15. One or more of the projections, 21A, 21B and/or 21C, has an associated key or plate, 18A and/or 18B, that fits into or mates with a corresponding keyway, 24A and/or 24B.

FIG. 2 is a cross-sectional view of the cap 13 and of the insulator base 15 (not drawn to scale) shown in FIG. 1. The cap 13 includes a bulk component 14A and an optional layer 14B, resulting from a surface treatment, that covers one or more surfaces of the cap 13. Material for the bulk component 14A of the cap may include a high temperature, low density, carbonaceous, fibrous material with a surface layer 14B that results from a HETC treatment (referred to for convenience herein as a "HETC surface layer"), the fibrous material being drawn from a group including carbonaceous silicon carbide foam and similar porous high temperature materials. Application of the HETC surface treatment to provide the surface layer 14B, which has a thickness in a range of 2.5 mm or more, is discussed in the following. Optionally, the HETC surface layer may be deleted, if the material composition for the bulk component 14A of the cap 13 is an oxidization-resistant silicon carbide or another high-emittance, low catalysis material.

The material used in the cap 13 may be a refractory, oxidization-resistant, lightweight ceramic, carbon material, referred to herein as "ROCCI" and described in U.S. Pat. No. 6,225,248, issued to Leiser, Hsu and Chen and incorporated by reference herein. The ROCCI material is prepared by impregnating a porous carbon substrate with dialkoxy and trialkoxy silanes, drying the product, and pyrolyzing the combination in an inert atmosphere. The ROCCI material predominantly contains carbon, silicon and oxygen and will survive at temperatures up to at least 1700° F. Alternatively, silicon carbide or a similar refractory material can be used for the cap material. Application of a HETC surface treatment to the ROCCI product allows use of the resulting product up to temperatures of the order of 3000° F. and up to 3600° F. for time intervals of the order of 10 min. and 1 min, respectively.

The insulator base 15 includes a bulk component 16A and a surface layer 16B (optional) covering part or all of the surfaces of this bulk component, as illustrated in FIG. 2. The bulk component 16A for the insulator base 15 may be drawn from a wide range of low conductivity materials, such as boro-alumino-silicate fibrous insulations or other refractory material. Optionally, the bulk component 16A of the insulator base 15 is a fibrous refractory composite insulation ("FRCI") material (with or without surface treatment), which is disclosed in U.S. Pat. No. 4,148,962, incorporated by reference herein. The surface layer 16B is applied to create a TUFI-like material, disclosed in U.S. Pat. No. 5,079,082, incorporated by reference herein, and has a thickness in a range of 1-2.5 mm or more. Optionally, the HETC surface layer 16B may be deleted from the insulator base 15.

A transition region 12 between the cap 13 and the insulator base 15 has a thickness in a range of about 1.2 mm and preferably has a material composition, initially including a glass (e.g., borosilicate glass), a fraction of a polymer (e.g., an organopolysiloxane having unreacted silanol groups) and an optional emittance agent (e.g., selected fractions of $TaSi_2$ and/or $MoSi_2$ and/or $WSi_2$). This provides a reaction-cured glass that acts as an adhesive and a non-abrupt transition between the local thermal gradient and thermal expansion in the cap 13 and in the insulator base 15. The polymer substantially disappears (by volatilization or other process) in the subsequent high temperature processing. Fabrication and use of this material as a thin layer is discussed in U.S. Pat. No. 5,985,433, issued to Leiser, Hsu and Chen.

The material composition of the pin(s), 17A and/or 17B, is substantially the same as the material composition for the insulator base 15 and is generally different from the material composition for the ROCCI material used for the bulk of the cap 13. Preparation of the first end of the pin(s), 17A and/or 17B, includes a toughening application of $TaSi_2$, $MoSi_2$, $WSi_2$ and/or $B_2O_3.SiO_2$. The toughening application produces a material with lower thermal conductivity and lower thermal coefficient of expansion than the corresponding parameters for the ROCCI material. These differences are accounted for in the design.

The cap 13 and an adjacent portion of the insulator base 15 may experience temperatures as high as about 2600-2800° F., and the temperature decreases to an estimated 400° F. or less at the back side of the insulator base. The material used for the ceramic bond at the first end of the pin(s), 17A and/or 17B, or at the plate(s), 18A and/or 18B, is preferably different from the material used for the ceramic bond used at the second end of the pin(s), where the temperature is much lower. Because of the extreme temperature gradients in the direction of the axes of the pin(s), 17A and/or 17B, the average thermal expansion in the insulator base 15 will be less than the average thermal expansion in the cap 13, and the material compositions of the cap and the insulator base may be chosen to take account of this. Preferably, the material used for the cap 13 has a thermal expansion coefficient that is the same as, or higher than, the thermal expansion coefficient of the material used for the insulator base 15.

In fabrication of the cap 13, the insulator base 15 and/or the pin(s), 17A and/or 17B, the workpiece is sintered at about T=2400° F. or higher for a selected time interval (length $\Delta t \geqq 10$ min). Use of a sintering temperature greater than 2400° F. does not appear to degrade the resulting material and may allow use of a smaller length time interval. Use of a sintering temperature substantially less than T=2400° F. will require a longer sintering time (e.g., $\Delta t=90$ min) at T=2225° F.).

The various composites used here include insulating composites capable of surviving high heating rates and large thermal gradients in the aero-convective heating environment that entry vehicles are exposed to characteristically. For one embodiment, the composites are formed of a ceramic surface layer overlying a substrate. For a further embodiment, the ceramic material impregnates a surface of the substrate to form a surface layer that is a functionally gradient composite structure. These ceramic surface layers can be applied to blunt and sharp wedge shaped configurations as well as the conventional shaped tile used on current high-speed atmospheric re-entry vehicles. Tailored formulations of this new family of tantalum silicide-based materials make them compatible with a wide variety of different lightweight fibrous systems.

The ceramics of the various embodiments are formed from four primary parts, three of which are shown in a composition diagram in FIG. 3. A first material component is tantalum disilicide ($TaSi_2$), which can act as either the emittance agent or as the matrix itself, depending upon the composition. A second material component is molybdenum disilicide ($MoSi_2$), which acts as a secondary emittance agent or as an oxygen getter within the finished composite.

A third material component (optional) is tungsten disilicide ($WSi_2$), which behaves in a manner similar to the first and/or second components. A fourth material component, borosilicate glass ($B_2O_3.SiO_2$), acts as a source for boron and as an alternative matrix depending upon the composition. A fifth material component is silicon hexaboride ($SiB_6$), which acts as a processing aid. The fifth component is a minor constituent and generally ranges from about 1-5 percent by weight of the total composition. As used herein, all composition percentages will be by weight unless otherwise noted.

FIG. 3 shows a composition diagram excluding the silicon hexaboride processing aid and illustrates the wide range of formulations that have been demonstrated for surface treatments of the various embodiments for use in aerospace applications. The boxed area 105 approximates the range of formulations demonstrated to be suitable for such aerospace applications having borosilicate glass compositions of approximately 10-95 percent, tantalum disilicide compositions of approximately 5-70 percent, and molybdenum disilicide compositions of approximately 0-30 percent. More preferably, the composition, excluding processing aids, includes approximately 20-45 percent borosilicate glass, 10-65 percent tantalum disilicide and 5-30 percent molybdenum disilicide. Underlying or sub-layers containing approximately 20-60 percent molybdenum disilicide, approximately 40-80 percent borosilicate glass and approximately 1-5 percent of a processing aid, (e.g., silicon hexaboride), may be used to aid in the integration of outer or surface layers of ceramic to the substrate. The sub-layers may impregnate a portion of the substrate to create a functionally gradient composite structure. The sub-layer preferably closely matches the coefficient of thermal expansion (CTE) of the substrate while subsequent layers may be used to increase the density and CTE of the surface layer.

Formulations, with matching CTE have been integrated into oxide-based Alumina Enhanced Thermal Barrier (AETB) tiles and carbon preforms of various compositions and density. The formulations of the various embodiments were either painted or sprayed onto the selected preform before being sintered at either 2225° F. (1220° C.) for 90 minutes or 2400° F. (1315° C.) for 10 minutes in a furnace at atmospheric pressure. The high temperature fast sintering process along with the process for applying the treatment itself minimizes the oxidation of the tantalum disilicide acting as the major constituent within the majority of the ceramics produced. The molybdenum disilicide behaves like a secondary emittance agent or as an oxygen getter inhibiting the oxidation of the tantalum compounds present. The fabrication process results in a high viscosity quasi-amorphous structure that has high emittance in one instance and high emittance ceramic in the other.

Figure 4A:
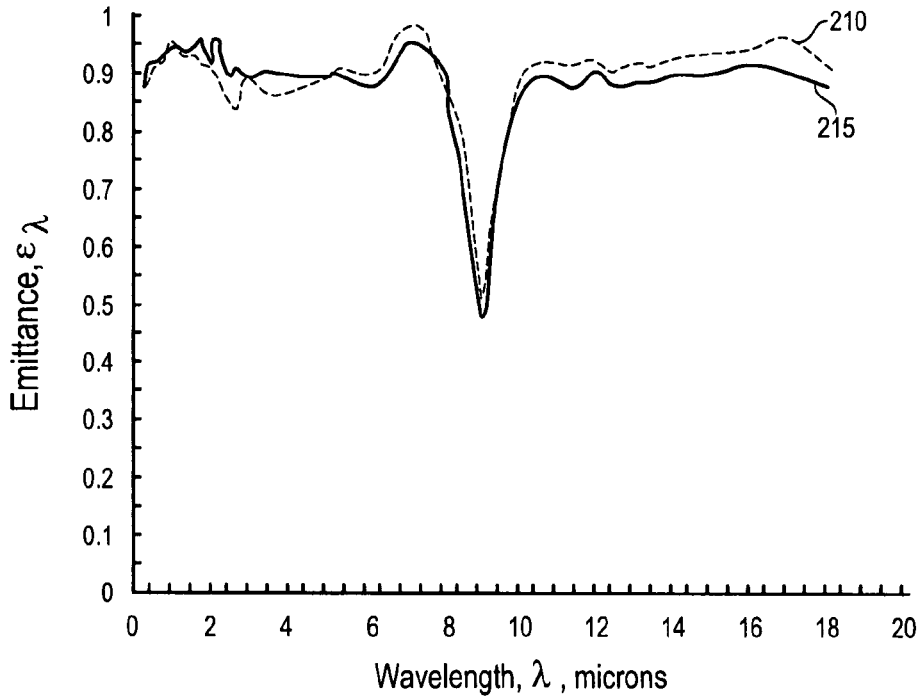
FIGS. 4A and 4B graphically illustrate hemispherical emittance of a ceramic composite prepared in accordance with the invention.
Figure 4B:
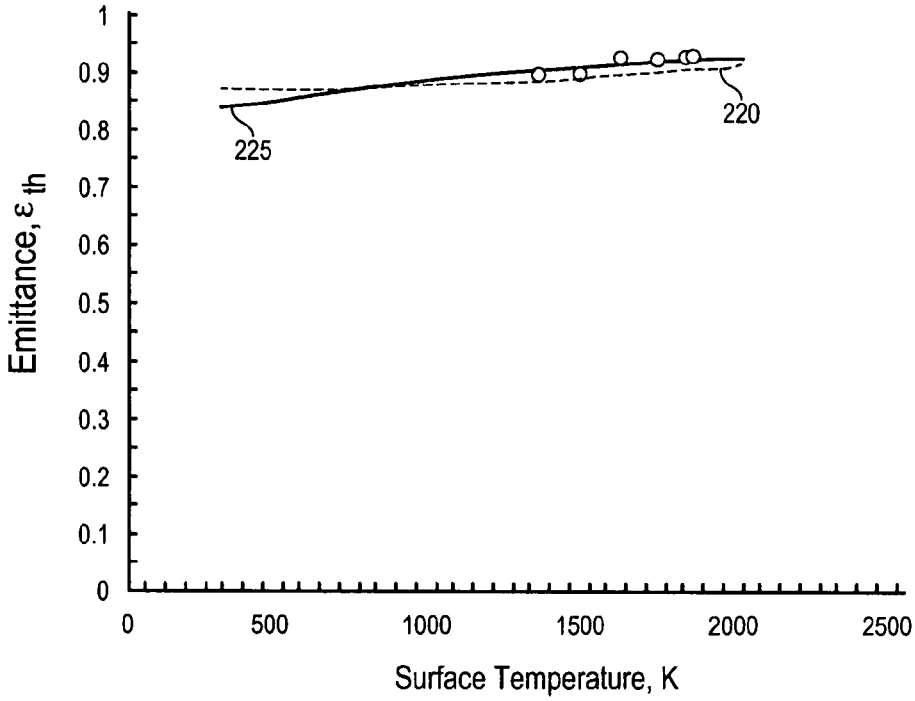

Compositions of the various embodiments have been applied to both simulated wing leading edge (WLE) and sharp wedge configurations in order to study the resulting thermal protection system (TPS) performance in high-energy arc-jet flow. A blunt wedge (approximately 1.5 inch radius) made using AETB-40/12 with a surface layer containing a 35 percent tantalum disilicide and 20 percent molybdenum disilicide formulation demonstrated re-use capability of a toughened fibrous ceramic (a functionally gradient composite) surface to heat fluxes up to 70 W/cm$^2$ in arc-jet flow. FIG. 4A shows that the spectral hemispherical emittance of this formulation is relatively unchanged. Line 210 shows the spectral hemispherical emittance prior to arc-jet exposure while line 215 shows the spectral hemispherical emittance after arc-jet exposure. FIG. 4B demonstrates that the total hemispherical emittance remains high, approximately 0.9 or above, after arc-jet exposure to surface temperatures above 2800° F. (1540° C.) for 50 minutes. Line 220 shows the total hemispherical emittance prior to arc-jet exposure while line 225 shows the total hemispherical emittance after arc-jet exposure.

In addition, a material composition of 65 percent tantalum disilicide and 15 percent molybdenum disilicide was successfully applied to a sharp leading edge configurations (wedge with approximately 0.06 inch radius). These test articles were made using silicon oxycarbide and carbon preforms. These test articles were tested for short exposure times (1.0 minute) to heat fluxes in excess of 300 W/cm$^2$.

Figure 5A:
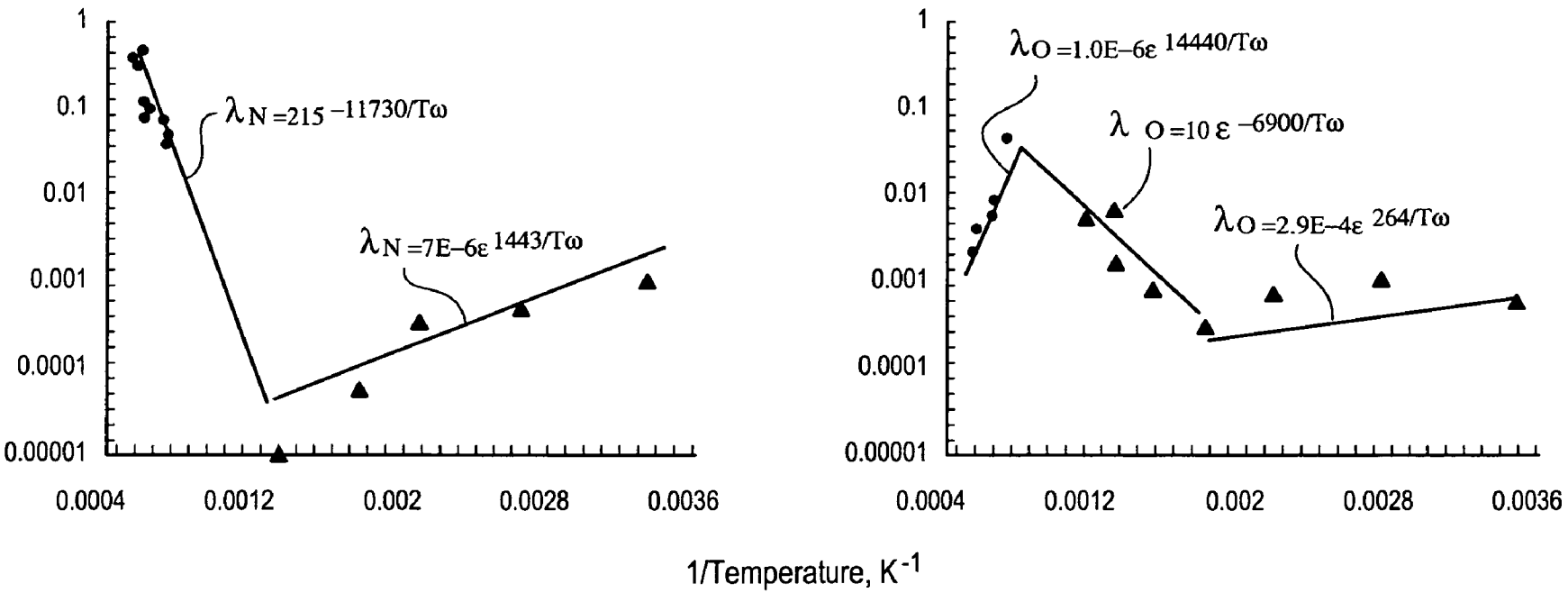
FIGS. 5A, 5B and 5C graphically compare atom recombination coefficients for conventional materials with the ceramic composites used in accordance with the invention.
Figure 5B:
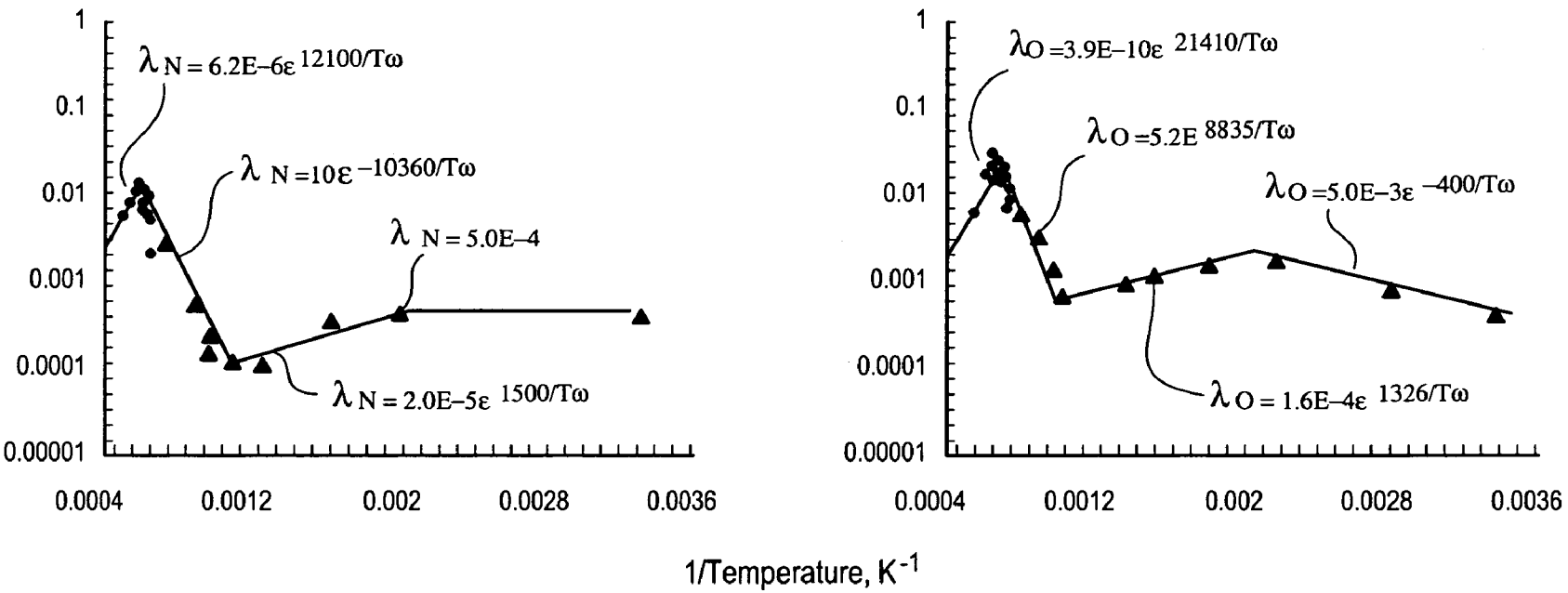
Figure 5C:
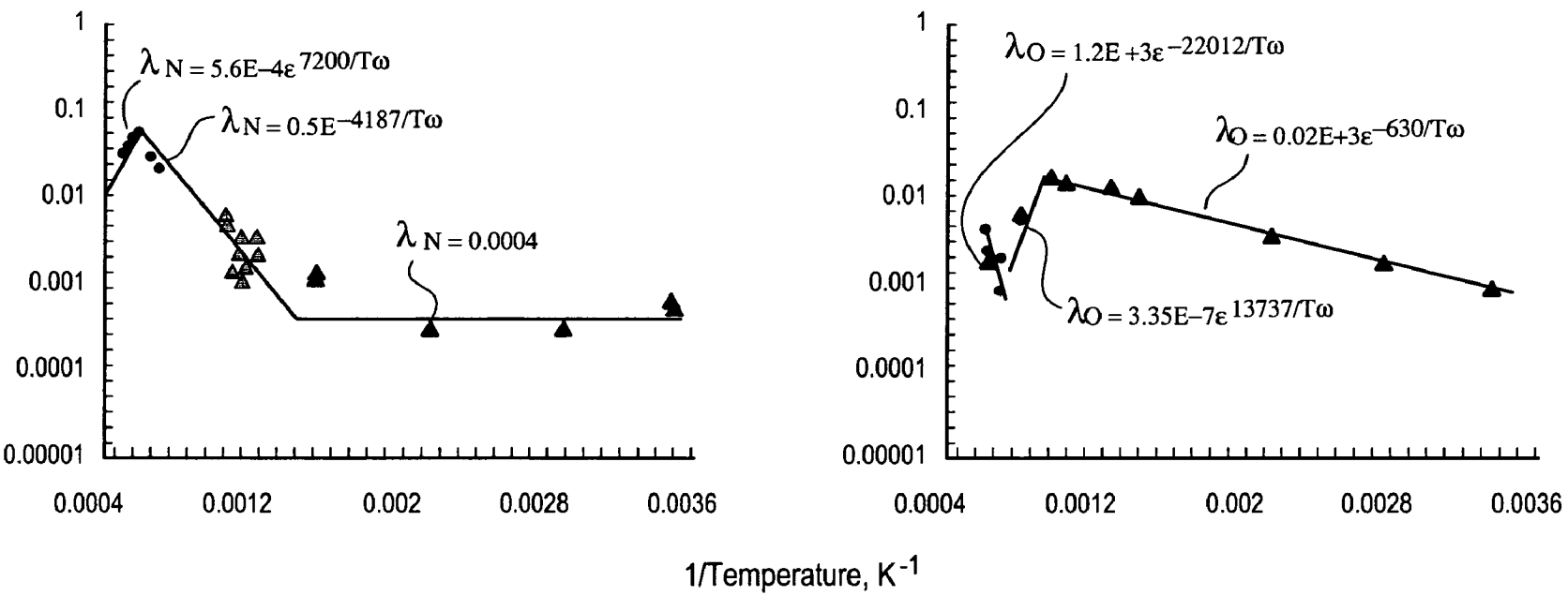

Another important characteristic of the ceramic composites of the various embodiments is illustrated with reference to FIGS. 5A, 5B and 5C, which are graphs of atom recombination coefficients for oxygen and nitrogen. These coefficients have a direct effect on the heat transfer rate to a re-entry vehicle's thermal protection system (TPS) during high-energy hypersonic flight. The lower the value the less the heat transfer rate (lower surface temperature) to the surface of the TPS due to reduced chemical heating (atom recombination). FIG. 5A represents the recombination coefficients for an RCG surface. FIG. 5B represents the recombination coefficients for a TUFI surface. FIG. 5C represents the recombination coefficients for a ceramic composite in accordance with an embodiment of the invention. As can be seen, the values of the recombination coefficients for nitrogen ($g_N$) and oxygen ($g_O$) for ceramics are very comparable with those for an RCG system, thus making these new materials very attractive. The low recombination coefficient is also indicative of an amorphous or quasi-amorphous surface structure, similar to RCG. X-ray diffraction analyses of a 35 percent tantalum disilicide and 20 percent molybdenum disilicide formulation indicates that the surface actually became more amorphous after arc-jet exposure.

Figure 6:
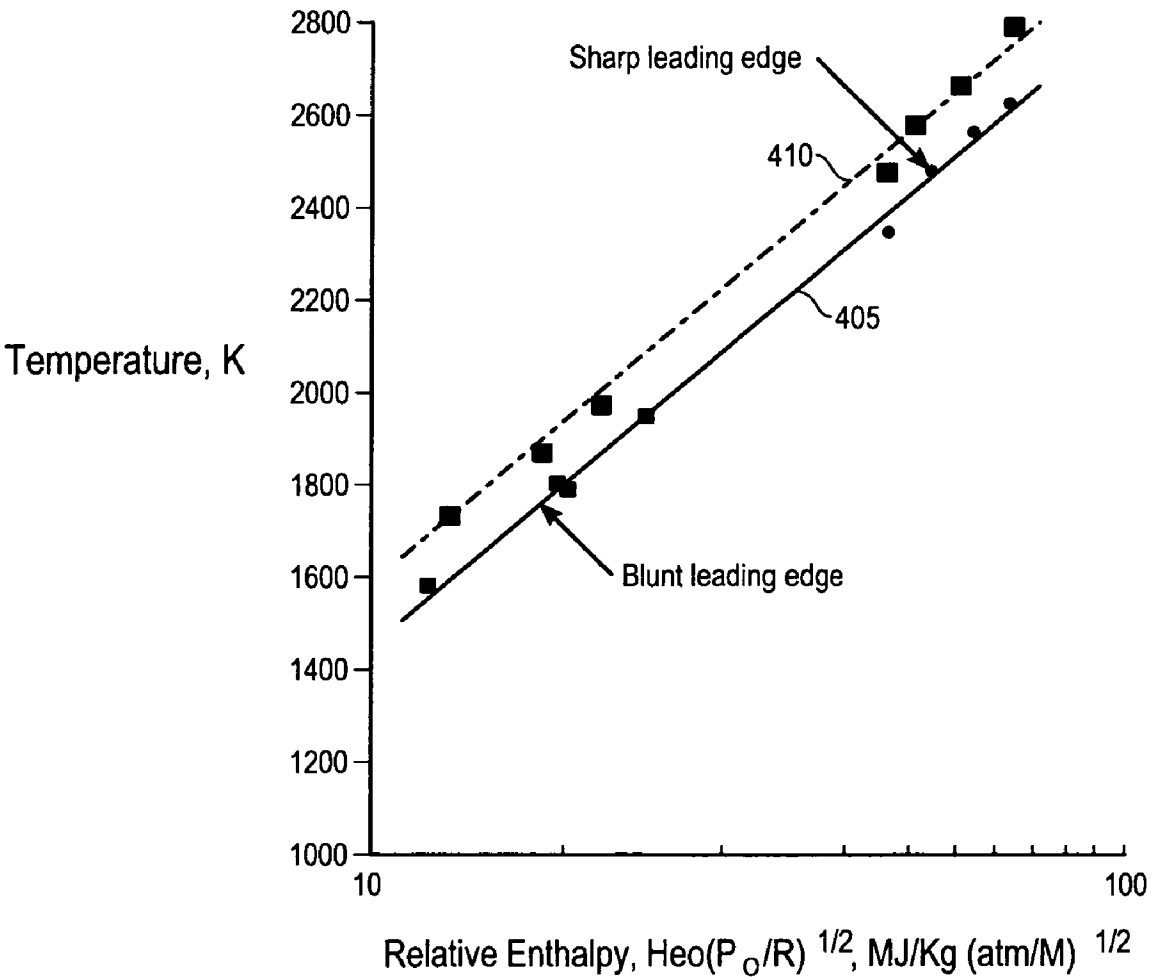
FIG. 6 is a graph of surface temperature versus relative enthalpy, comparing a fully catalytic surface to a ceramic composite used in accordance with the invention.

Use of ceramic compositions in accordance with the invention into a heat shield for a spacecraft (using either a fibrous and/or foamed substrate) can facilitate a reduction of the surface temperature during Earth atmosphere re-entry of several hundred degrees below the values calculated assuming a fully catalytic wall. This is best illustrated in FIG. 6, which compares the measured surface temperature taken from a cone made using a ceramic composite in accordance with the invention, i.e., solid line 405, with predicted values for a similar cone assuming a fully catalytic wall, i.e., dashed line 410.

Figure 7A:
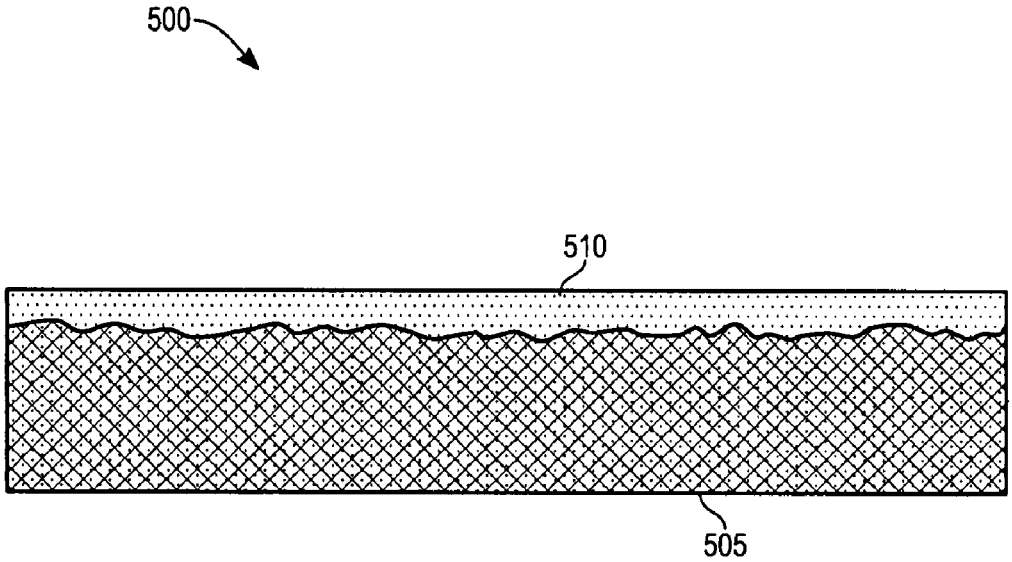
FIGS. 7A and 7B are cross-sectional views of composite insulating structures used in accordance with the invention.
Figure 7B:
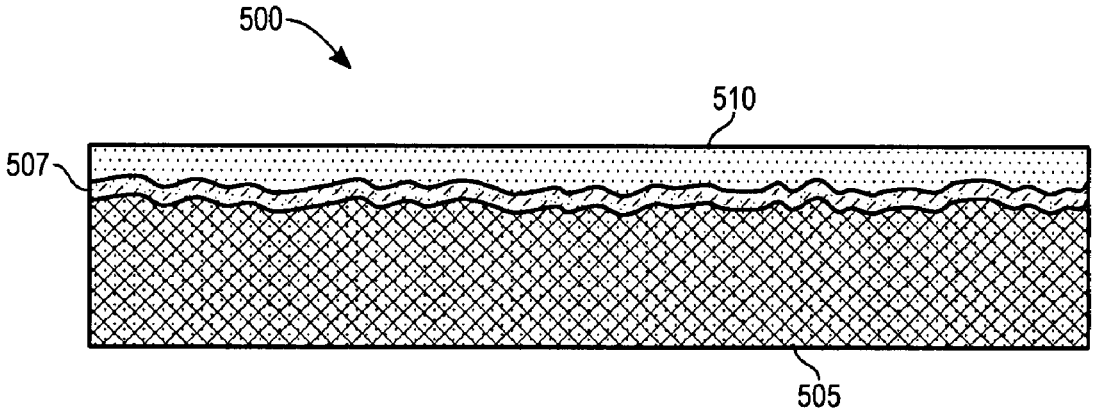

FIGS. 7A and 7B are cross-sectional views of composite insulating structures 500 used in accordance with the invention. While the structures 500 are shown to have substantially planar surfaces, other forms are also suitable, such as rounds, blunt wedges, sharp wedges or more complex geometries. The structures 500 include a substrate 505 and a ceramic surface layer 510 overlying and adjoined to the substrate 505. In forming the surface layer 510, it is preferred that the particle size of the components be reduced to allow impregnation of a surface or outer portion of the substrate 505 during application of the surface layer material, thereby forming a transition layer 507 containing substrate 505 and ceramic surface layer 510 as shown in the embodiment of FIG. 7B. Each component of the surface layer 510, i.e., the $MoSi_2$, $TaSi_2$ and borosilicate glass, as well as processing aids that do not materially affect the basic and novel characteristics of the ceramic surface layer(s) described herein, may be ball-milled separately or together in ethanol at 20-30 percent solids by weight for a suitable time to reduce particle size.

For one embodiment, the desired particle size is less than about 5 mm. For a further embodiment, the desired particle size has a maximum diameter of less than about 5 mm and a diameter mode of approximately 1 mm. After milling, the resultant slurries are combined, if necessary, to achieve a homogeneous dispersion. The dispersion may then be sprayed, painted or otherwise applied to a surface of the substrate 505. One or more applications may be performed to achieve a desired thickness. Alternatively, or in addition, individual applications may have the same composition, or the composition may be altered for one or more layers. For example, initial layers applied to the substrate 505 to form the transition layer 507 through impregnation may have a first composition. Subsequent layers, applied to the substrate 505 to form the outer surface layer 510 overlying the substrate 505, may have a second composition.

For one version of the composite, the amount of ceramic material used for surface layer 510 is adjusted to provide from approximately 0.07-0.21 g/cm$^2$ of surface layer 510. For a further embodiment, the amount of ceramic material used for surface layer 510 is adjusted to provide approximately 0.14 g/cm$^2$ of surface layer 510. Suitable examples of the substrate 505 include silica, fibrous refractory composite insulation (FRCI), and AETB. Further examples include fibrous and/or foamed silicon carbide and silicon oxycarbide.

After application of the surface layer 510, the structure 500 can be dried overnight at room temperature or for about two to about five hours at temperatures up to about 158° F. (70° C.). After drying, the surface layer 510 is sintered at approximately 2225° F. (1220° C.) for 90 minutes or 2400° F. (1315° C.) for 10 minutes in a furnace at atmospheric pressure. The structure 500 is normally inserted into the furnace at temperature and cooled by rapid removal from the furnace. The final surface layer 510 appears flat black and is pervious to water penetration. For one embodiment, the composition of the surface layer 510 is adjusted such that its coefficient of thermal expansion after sintering substantially matches the coefficient of thermal expansion of the underlying substrate 505.

One, two or more components of the structure 11 in FIG. 1 or 1A can be provided with a thin coating, preferably of thickness no greater than 10-50 μm, of a reaction cured glass (RCG) formulation, as described in U.S. Pat. No. 4,083,771 ("Reaction Cured Glass And Glass Coatings"), incorporated by reference herein. An RCG is prepared by reacting a mixture of glasses, including a porous, high silica borosilicate glass (e.g., Vycor 7930) with boron oxide to prepare a reactive glass frit. The frit is reacted with one or more selected intermetallic or metallic substances (e.g., silicon tetraboride, silicon hexaboride, boron silicide. Finely divided particles of these materials are blended together with a carrier, such as ethanol, and a pre-carrier, such as methylcellulose. The mixture (referred to herein as an "RCG formulation") is applied to a silica surface insulation substrate, or any other porous silica substrate or other ceramic substrate.

Application of the RCG formulation appears to reduce the oxidization reactions and to decrease the catalytic efficiency on a coated surface, for temperatures above 2800° F. For example, a heated structure without a coating of the RCG formulation resulted in a maximum temperature of about 3100° F., and resulted in a maximum temperature of about 3000° F. with a coating of the RCG formulation applied. A modified RCG formulation may include silica having a first volume fraction of about 0.94-1.00 and borosilicate having a second volume fraction of about 0-0.06.

EXAMPLE 1

In a first embodiment, a four-inch long wing leading edge tile component is prepared by machining all components separately. A cap, including carbonaceous, fibrous material, is converted to a silicon-oxy-carbide, and a HETC surface treatment is applied to selected surfaces before assembly. The surface treatment applied to the silicon-oxy-carbide cap material (ROCCI) and insulator base material are configured to form functionally gradient composites. All exposed surfaces of the cap are treated with a HETC surface treatment, illustrated in FIG. 7B. The top layer composition for the cap includes tantalum disilicide, molybdenum disilicide, silicon hexaboride and borosilicate glass, with respective fractions of 50 percent, 20 percent, 2.5 percent and 27.5 percent. The sub-layer composition for the cap includes tantalum disilicide, molybdenum disilicide, silicon hexaboride and borosilicate glass with respective fractions of 35 percent, 20 percent, 2.5 percent and 42.5 percent.

The HETC surface treatment applied to the exposed front and side surfaces of the insulator base includes a top layer composition of tantalum disilicide, molybdenum disilicide, silicon hexaboride and borosilicate glass, with respective fractions of 35 percent, 20 percent, 2.5 percent and 42.5 percent. The sub-layer composition for the insulator base includes molybdenum disilicide, silicon hexaboride and borosilicate glass with respective fractions of 55 percent, 2.5 percent and 42.5 percent. A pin and the insulator base are bonded to the cap using 53 percent polymer and about 47 percent borosilicate glass. The pin is bonded within the keyway to the cap. All interface surfaces between the cap and the insulator base are bonded upon assembly using a mixture of 53 percent polymer and 47 percent borosilicate glass. The assembled tile component is sintered at 2400° F. for 10 minutes. The exposed base of the pin at the back surface of the insulator base is secured to the back surface using RTV560 adhesive, after sintering.

Figure 8A:
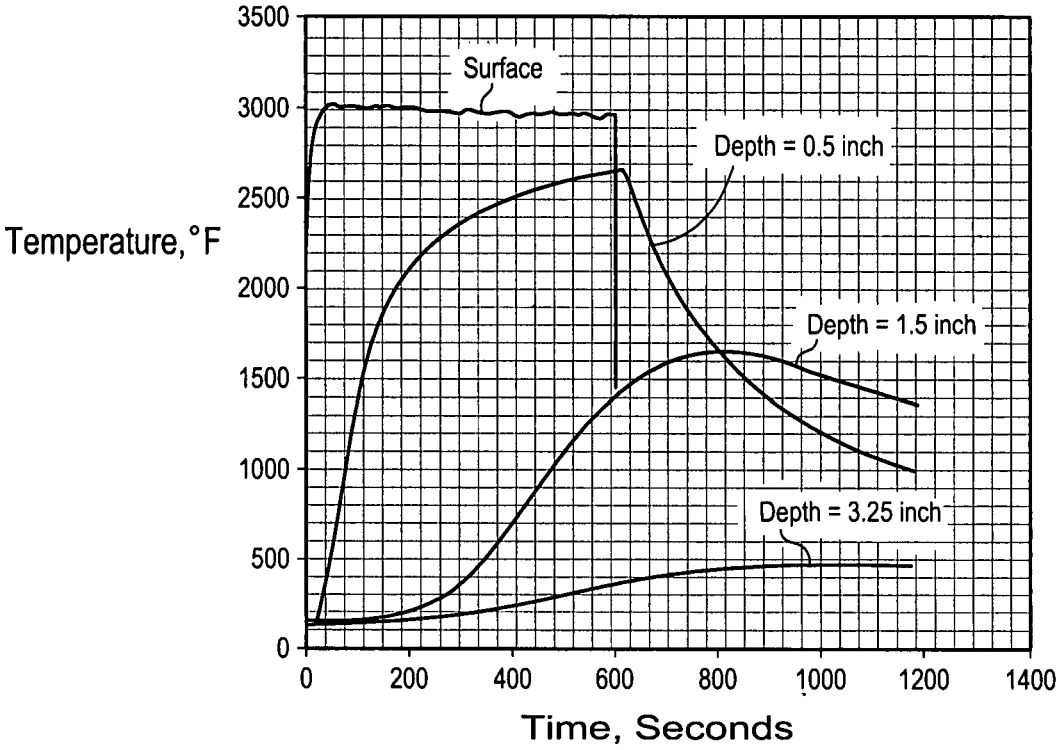
FIGS. 8A and 8B graphically present temperature versus time development for the two-component invention and for a single-component formulation.
Figure 8B:
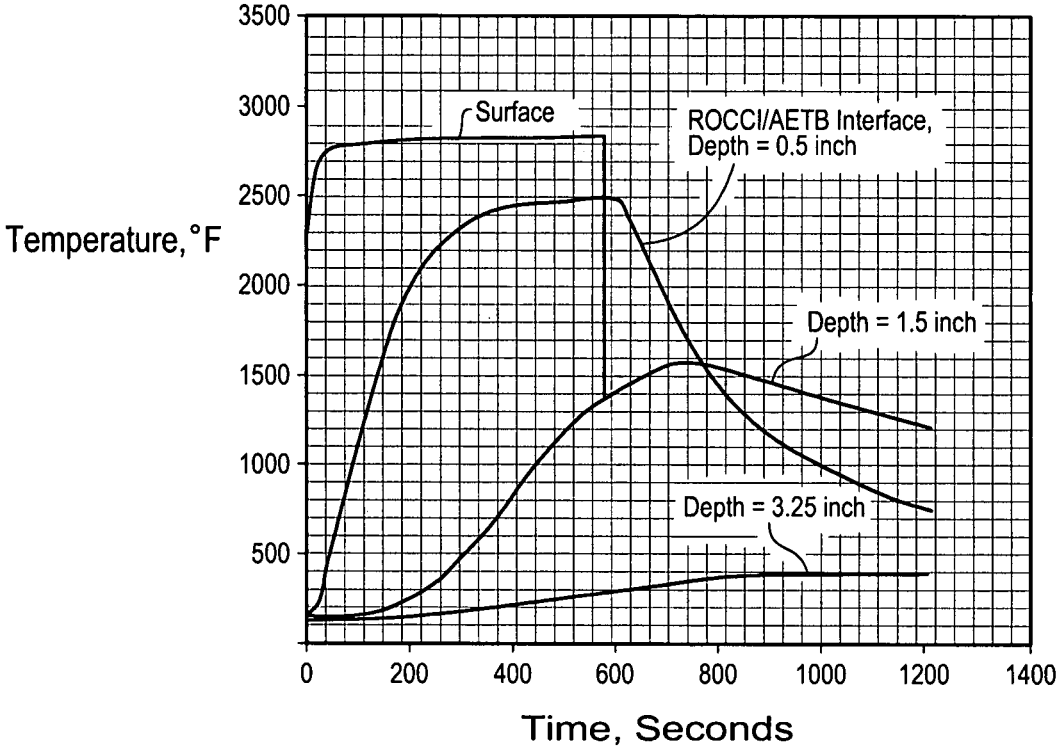

FIGS. 8A and 8B present temperature versus time graphs at various depths for a two-component tile, prepared according to the procedure in Example 1 (FIG. 8B: "TUFROC"), and for a single-component tile (FIG. 8A: "TUFI-HT"). These graphs illustrate development of nearly identical temperature versus time curves at the exposed cap surface, at the cap-insulator base interface, and at depths of about 1.5 inches and 3.25 inches within the insulator base component, for the two formulations.

EXAMPLE 2

In a second embodiment, an eight-inch long wing leading edge tile component prototype is prepared by first roughly machining the cap. The cap, a carbonaceous, fibrous material is converted to a silicon-oxy-carbide material, and a HETC surface treatment is applied to the underside of the cap. A surface treatment is applied to the insulator base in the same manner as in Example 1. The exposed surfaces of the cap and the cap-insulator base transition layer are treated as in Example 1. The front and side surfaces of the insulator base and the insulator base transition region are treated as in Example 1. The components are bonded together, using 53 percent polymer and 47 percent borosilicate glass, and the outer mold line (OML) of the tile assembly is machined. Tailored surface treatments of the cap and base insulator are applied to the exposed surfaces of the assembled tile. The assembly is sintered at T=2400° F. for 10 minutes. The exposed base of the pin at the back surface of the insulator base is secured to the back surface using RTV560 adhesive, after sintering.

EXAMPLE 3

In a third example, an eight-inch long wing leading edge tile is prepared by first converting the cap material (carbonaceous fibrous insulation) to a silicon-oxy-carbide (ROCCI) and machining the converted cap material to the desired configuration. The insulator base for this system is an aluminosilicate fibrous material. The surface treatment for the cap and insulator base are applied to form a functionally gradient composite. A TUFFROC tile system is fabricated as follows. (1) Standard TUFI formulation (40 percent) is applied to all surfaces of the insulator base. (2) Internal and external end surfaces of the ROCCI cap are treated with a prepared mixture of 50 percent tantalum disilicide, 20 percent molybdenum disilicide, 2.5 percent silicon hexaboride and 27.5 percent borosilicate glass; a sub-layer for the ROCCI cap is 35 percent tantalum disilicide, 20 percent molybdenum disilicide, 2.5 percent silicon hexaboride and 42.5 percent borosilicate glass. (3) A modified QUIC FIX solution is applied to the flange end, 18A and 18B, of the ceramic pin, 17A and 17B, in FIG. 1, and the flange end is bonded into the cap at location(s) 24A and 24B in FIG. 1A. (4) The modified QUIC FIX solution is applied to mating surfaces between the cap and the insulator base. (5) The insulator base and cap are assembled and secured, using a shim at the notched end of the pin 17, located at an inter-mold line for the base insulator. (6) After setting for about 24 hours, a mixture of 35 percent tantalum disilicide, 20 percent molybdenum disilicide, 2.5 percent silicon hexaboride and 42.5 percent borosilicate glass is applied over the exposed surfaces of the assembly; this becomes a sub-layer for the ROCCI outer surface and a second layer for the insulator base. (7) A mixture of 50 percent tantalum disilicide, 20 percent molybdenum disilicide, 2.5 percent silicon hexaboride and 27.5 percent borosilicate glass is applied to the outer surface of the ROCCI cap. (8) A mixture, equivalent to the RCG formulation, is applied over the exposed surfaces of the TUFFROC system, excluding the butted ends of the composite tiles. (9) The assembled TUFFROC tile system is sintered for ten minutes at T=2400° F. in air. (10) The shim attached to the pin at the insulator base is removed, and the pin is trimmed flush with the inter-mold line. (11) The base of the pin is secured to the insulator, using an RTV560 adhesive or equivalent adhesive. This formulation of TUFFROC was successfully tested in a high enthalpy hypersonic flow with surface temperatures greater than 3000° F. for 16 minutes and with surface temperatures greater than 3100° F. for 4 minutes.

What is claimed is:

1. A method for thermal protection, the method comprising:

providing a cap, having at least one exposed surface and a cap interface surface spaced apart from the cap exposed surface, where the cap has at least one polygonal or curvilinear depression and one or more bosses at the cap interface surface, each boss having at least one threaded buttress or keyway in the cap, the cap having a material composition including carbon and silicon and having at least first and second spaced apart depressions in the cap interface surface;

providing a cap surface layer, positioned at the cap exposed surface, having a surface layer thickness in a selected range of about 1-2.5 mm, and having a material composition comprising a first selected fraction of tantalum disilicide, a second selected fraction of molybdenum disilicide, a third selected fraction of tungsten disilicide and a fourth selected fraction of glass, wherein the cap surface layer is subjected to a HETC treatment;

providing an insulator base having an insulator base interface surface including at least one polygonal or curvilinear projection, which mates with the respective at least one depression in the cap interface surface and which compensates for a difference in thermal expansion between the cap and the insulator base at the insulator base interface surface, where the insulator base has an insulator base second surface spaced apart from the insulator base interface surface, has at least one insulator base aperture that extends from the insulator base interface surface to the insulator base second surface, and has a material composition including alumina and including at least one of silica, boron or other refractory material;

providing a transition region, positioned between, and contiguous to, the cap interface surface and the insulator base interface surface, having a thickness of about 1.2 mm or more, having a material composition comprising glass, a selected polymer and a selected mixture of at least two of $TaSi_2$, $MoSi_2$, $WSi_2$, and $B_2O_3.SiO_2$, and having at least one transition region aperture at a location corresponding to the at least one insulator base aperture;

extending at least one pin that through the at least one insulator base aperture and through the at least one transition region aperture, that has a plate or key at a first pin end that is received in the at least one threaded buttress or keyway, that is bonded to the cap at the first pin end, and that is bonded to the insulator base second surface at a second pin end, the pin having a material composition that is substantially the same as the material composition of the insulator base component; and providing a coating, having a selected thickness in a range of about 10-50 μm, of reaction cured glass formulation covering exposed surfaces of at least one of the cap, the insulator base, the transition region and the pin.

2. The method of claim 1, further comprising choosing said material composition of said cap to withstand temperatures up to or above 3000° F. over a selected time interval.

3. The method of claim 2, further comprising choosing said selected time interval to be at least 16 minutes.

4. The method of claim 1, further comprising choosing said material composition of said cap to withstand temperatures up to or above 3100° F. for a time interval of at least 4 minutes.

5. The method of claim 1, further comprising choosing said reaction cured glass formulation to include a first volume fraction of about 0.94-1.00 of silica and a second volume fraction of about 0-0.06 of borosilicate glass.

6. The method of claim 1, further comprising providing said cap surface as a functionally gradient layer.

7. The method of claim 1, further comprising choosing said first fraction, said second fraction and said fourth fraction within respective ranges 5-70 percent, 0-30 percent and 10-95 percent.

8. The method of claim 1, further comprising choosing said cap material to be primarily ROCCI.

9. The method of claim 1, further comprising choosing said glass in said cap coating material to be primarily borosilicate glass.

10. The method of claim 1, further comprising choosing said cap material to be primarily silicon carbide.

11. The method of claim 1, further comprising choosing said cap material to be primarily silicon-oxy-carbide.

12. The method of claim 1, further comprising providing an insulator base surface layer, positioned at said insulator base interface surface, having a surface layer thickness in a selected range 1-2.5 mm, and having a material composition comprising a fifth selected fraction of tantalum disilicide, a sixth selected fraction of molybdenum disilicide, a seventh selected fraction of tungsten disilicide and an eighth selected fraction of glass; and subjecting the insulator base surface layer to a HETC treatment.

13. The method of claim 12, further comprising providing said insulator base surface layer as a functionally gradient layer.

14. The method of claim 12, further comprising providing said fifth fraction, said sixth fraction and said eighth selected fractions in respective ranges 5-70 percent, 0-30 percent and 10-95 percent.

15. The method of claim 12, further comprising providing said glass in said insulator base coating material is primarily borosilicate glass.

16. The method of claim 1, further comprising choosing said insulator base material to be primarily TUFI.

* * * * *